US007207823B1

(12) United States Patent
Yang

(10) Patent No.: US 7,207,823 B1
(45) Date of Patent: Apr. 24, 2007

(54) PLUG CONNECTOR

(75) Inventor: Haven Yang, Sinjhuang (TW)

(73) Assignee: All Best Electronics Co., Ltd., Taipei (TW)

( * ) Notice: Subject to any disclaimer, the term of this patent is extended or adjusted under 35 U.S.C. 154(b) by 0 days.

(21) Appl. No.: 11/405,548

(22) Filed: Apr. 18, 2006

(51) Int. Cl.
*H01R 13/627* (2006.01)

(52) U.S. Cl. ..... 439/352

(58) Field of Classification Search ..... 439/476.1, 439/484, 483, 352–358, 610, 108, 378, 92, 439/95, 607, 906, 931, 372
See application file for complete search history.

(56) References Cited

U.S. PATENT DOCUMENTS 6,346,002 B1 * 2/2002 Hsu et al. ..... 439/358
6,454,577 B1 * 9/2002 Yi ..... 439/108
6,692,289 B2 * 2/2004 Nemoto ..... 439/352
6,890,205 B1 * 5/2005 Wu ..... 439/358
6,976,865 B2 * 12/2005 Wu ..... 439/352
7,147,502 B1 * 12/2006 Wu ..... 439/352

* cited by examiner

*Primary Examiner*—Truc T. Nguyen
*Assistant Examiner*—Edwin A. Leon
(74) *Attorney, Agent, or Firm*—Dykema Gossett PLLC

(57) ABSTRACT

A plug connector includes a main body having a forward plug head for plugging in a corresponding receptacle, and an axial middle slide way having a lowered section formed on a top surface; an elastic plate fixed to a rear end of the main body with two hooks formed at a front free end for engaging with two engaging holes on the receptacle; and a pull member having a forward projected section movably located in the middle slide way below the elastic plate. When the pull member is pulled rearward, a downward protruded front end of the forward projected section slides out of the lowered section onto the middle slide way to raise a middle section of the elastic plate, so that the hooks of the elastic plate disengage from the receptacle, allowing the plug head of the main body to unplug from the receptacle.

6 Claims, 5 Drawing Sheets

PLUG CONNECTOR

FIELD OF THE INVENTION

The present invention relates to a plug connector, and more particularly to a plug connector having a fastening structure that secures the plug connector to a receptacle and could be easily operated to allow convenient unplugging of the plug connector from the receptacle.

BACKGROUND OF THE INVENTION

FIG. 1 shows the conventional fastening structure provided on a plug connector and a corresponding receptacle. As shown, a main body 5 of the conventional plug connector includes a forward projected plug head 51 for plugging in a plug hole 41 on the receptacle 4, so that a closed circuit is formed to allow signal transmission. A fastening element 52 is movably connected to a top of the main body 5. A rear end of the fastening element 52 has a push head 522. A spring 523 is mounted between the push head 522 and the main body 5. At least one hook 521 is provided at a front end of the fastening element 52 for engaging with a locating hole 42 correspondingly formed on the receptacle 4 near the plug hole 41, so that the main body 5 of the plug connector could be firmly held to the receptacle 4. When it is desired to separate the plug connector main body 5 from the receptacle 4, simply downward push the push head 522 of the fastening element 52 to lift and disengage the front hook 521 from the locating hole 42 of the receptacle 4. At this point, the plug head 51 of the connector main body 5 may be easily unplugged from the plug hole 41 of the receptacle 4.

The above-described fastening structure for plug connector has the following disadvantages in use:

1. A height by which the front hook 521 of the fastening element 52 is lifted is in direct ratio to the distance by which the push head 522 is downward pushed. However, as a result of the miniaturization of electronic products, it is not easy to increase the distance between the push head 522 and the main body 5.
2. To meet the requirement of miniaturized electronic products, the fastening element 52 must have a minimized thickness, which inevitably reduces the structural strength of the fastening element 52 to result in easy deformation of the fastening element 52. The lift height of the hook 521 fails to be in direct ratio to the depressed distance of the push head 522 when the fastening element 52 is deformed, preventing the hook 521 from efficiently disengaging from the locating hole 42.
3. The push head 522 is pushed in a direction normal to the direction in which the connector main body 5 is unplugged from the receptacle 4. It is inconvenient for a user to grip the main body 5 and unplug the plug head 51 from the plug hole 41 of the receptacle 4 while press and hold the push head 522.

It is therefore tried by the inventor to develop a plug connector with improved fastening structure that enables firm connection and easy disengagement of the plug connector to and from a receptacle.

SUMMARY OF THE INVENTION

A primary object of the present invention is to provide a plug connector, which includes a fastening structure that enables firm connection and easy disengagement of the plug connector to and from a receptacle, allowing a user to use the plug connector in a more convenient manner.

Another object of the present invention is to provide a plug connector, which includes a fastening structure that is operated in a direction the same as the direction in which the plug connector is unplugged from a receptacle, so that the plug connector could be more easily manipulated.

To achieve the above and other objects, the plug connector according to the present invention includes a main body having a front end that forward projects to form a plug head for extending into a plug hole correspondingly formed on a receptacle, the main body being provided on a top surface with an axially extended middle slide way, which is provided at a middle point with a lowered section, and near a rear end with a recess for receiving an elastic element therein; an elastic plate having a rear end fixed to a rear end of the main body opposite to the plug head, and a front end provided with two hooks that are located above a base of the plug head for hooking to two engaging holes correspondingly provided on the receptacle; and a pull member having a forward projected section located below the elastic plate to movably locate in the middle slide way on the top of the main body, the forward projected section having a downward protruded front end movably received in the lowered section of the middle slide way, and a stopper being downward projected from a lower side of the forward projected section near a rear end thereof to extend into the recess on the main body and press against a front end of the elastic element.

When the pull member is pulled rearward, the forward projected section is simultaneously moved rearward, causing the downward protruded front end to slide out of the lowered section onto the middle slide way and thereby presses against a middle section of the elastic plate above the pull member, and the hooks at the front end of the elastic plate are raised to disengage from the engaging holes on the receptacle to separate the main body of the plug connector from the receptacle.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
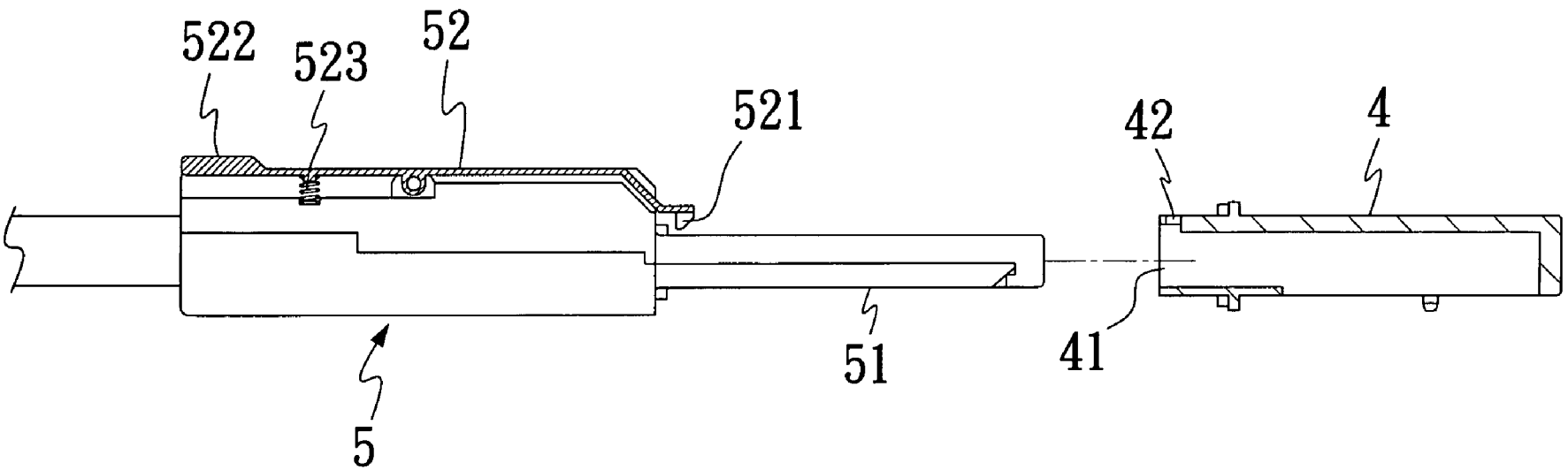
(PRIOR ART) Fig. 1
FIG. 1 is a sectioned side view of a conventional plug connector.
Figure 2:
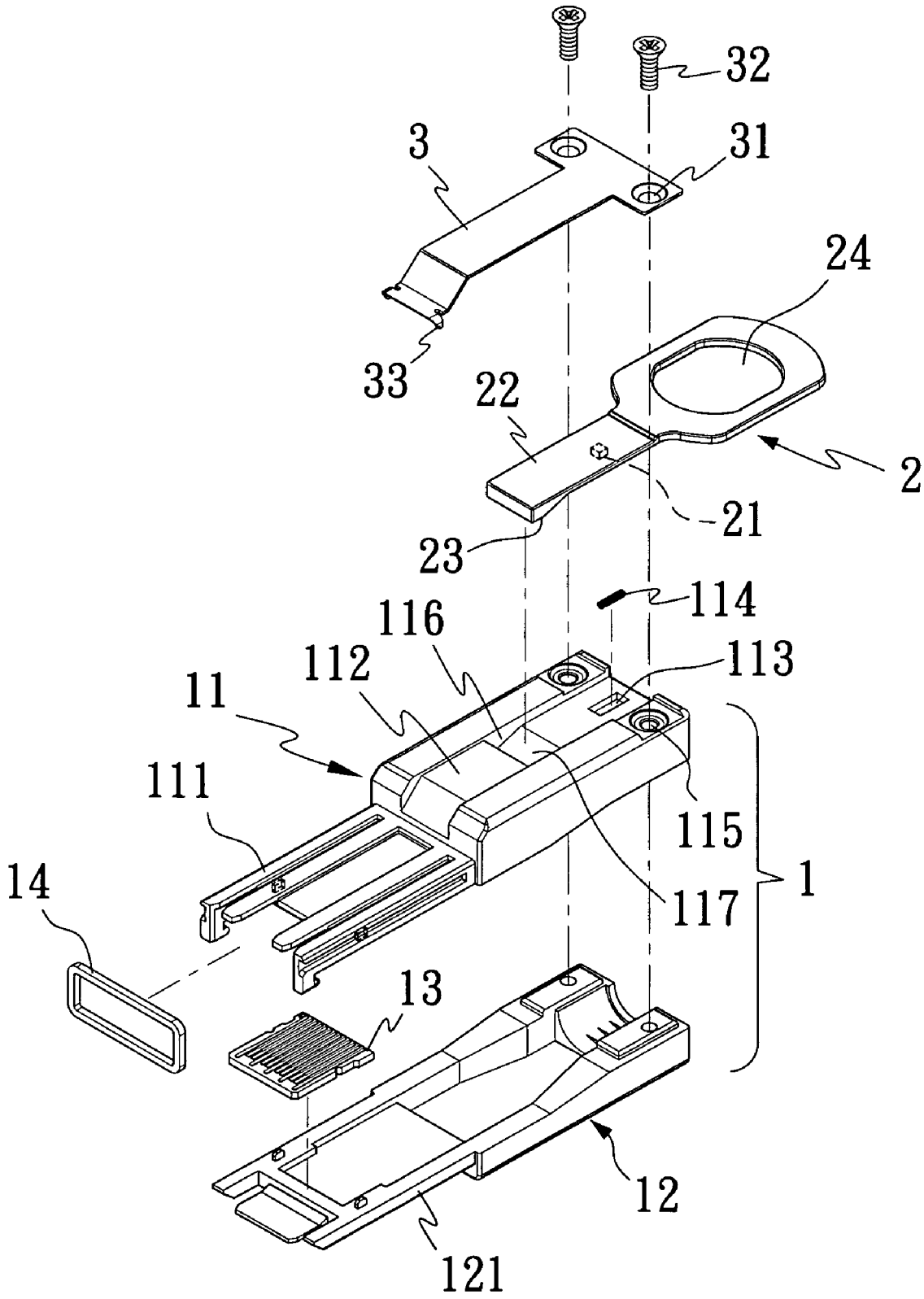
FIG. 2 is an exploded perspective view of a plug connector according to a preferred embodiment of the present invention.
Figure 3:
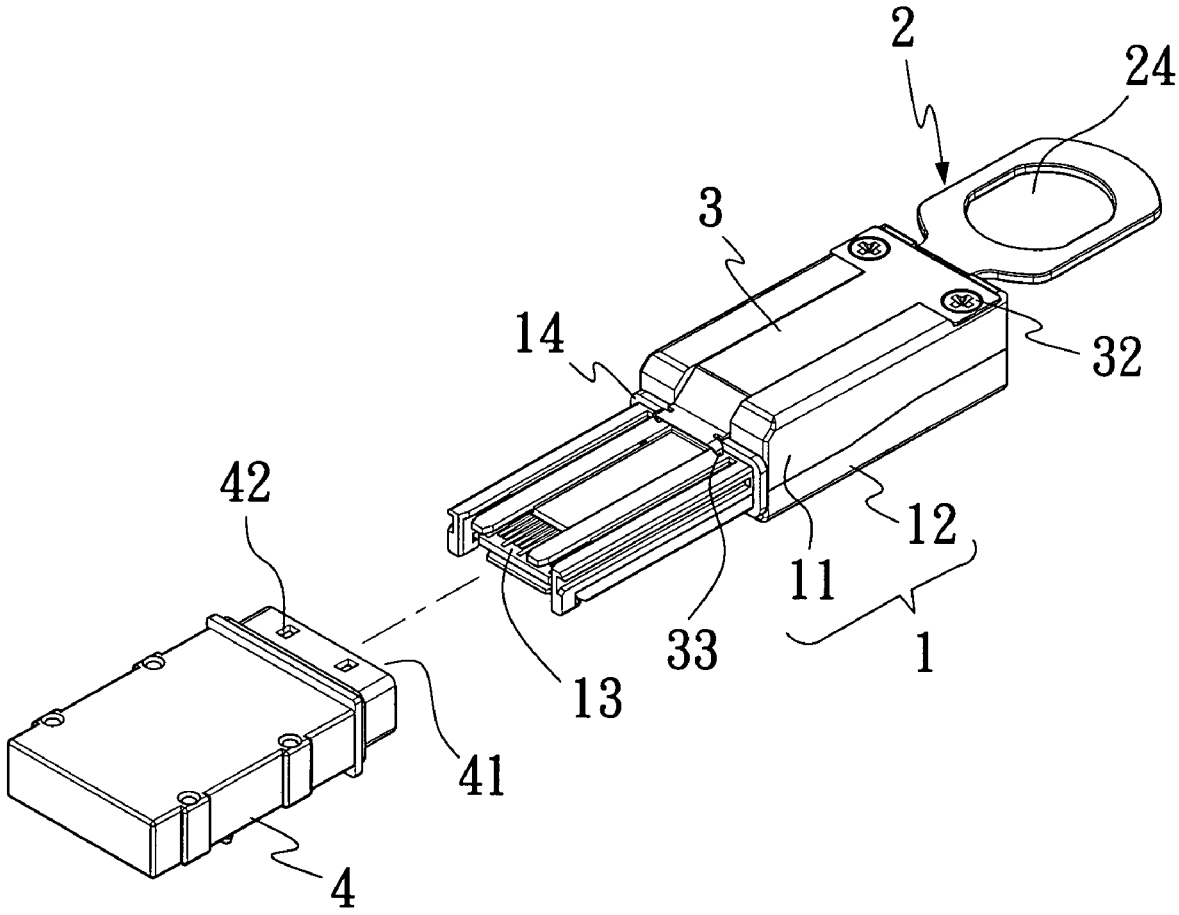
FIG. 3 is an assembled view of FIG. 2.

Please refer to FIGS. 2 and 3 that are exploded and assembled perspective views, respectively, of a plug connector according to a preferred embodiment of the present invention. As shown, the plug connector according to the present invention includes a main body 1, a pull member 2, and an elastic plate 3.

Figure 4:
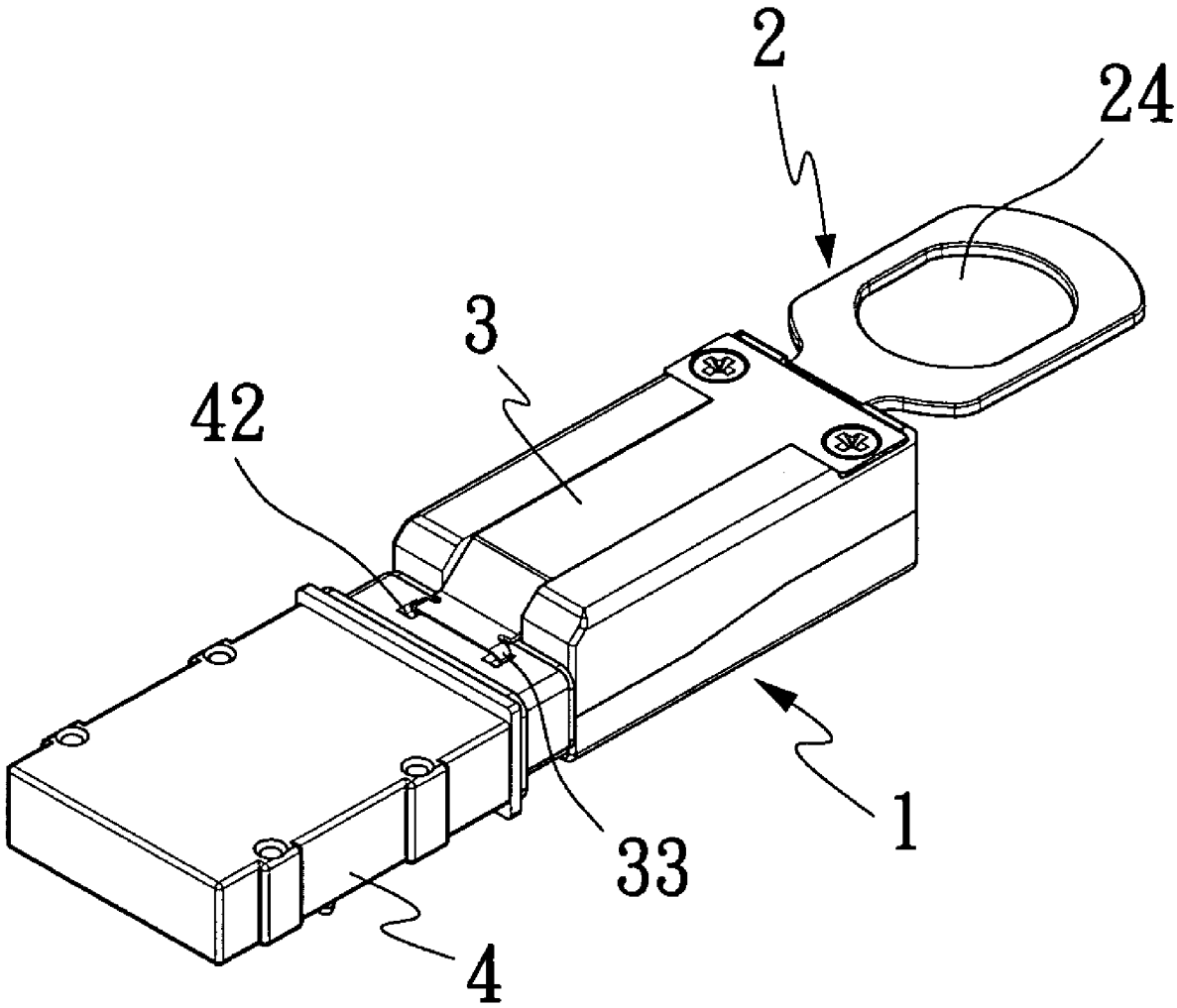
FIG. 4 shows the plug connector of FIG. 3 plugged in a corresponding receptacle.
Figure 5:
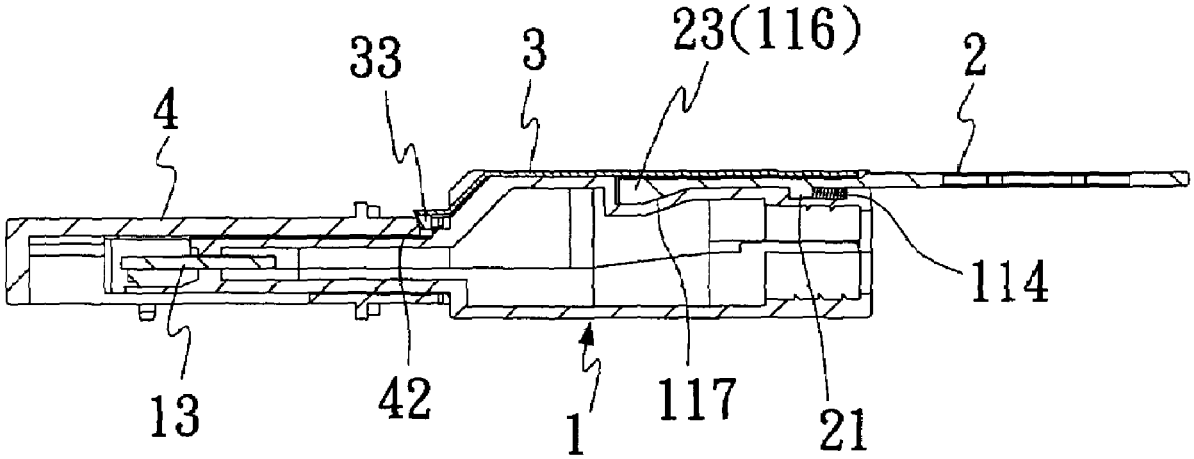
FIG. 5 is a sectioned side view of FIG. 4.

The main body 1 is formed from an upper case 11 and a lower case 12 closed to each other. An upper and a lower plug head 111, 121 are horizontally forward extended from a front end of the upper and the lower case 11, 12, respectively, for extending into a plug hole 41 on a receptacle 4 corresponding to the plug connector. A conductive rubber ring 14 is mounted around a base of the upper and the lower plug head 111, 121; and a circuit board 13 having signal wires connected thereto is mounted between the upper and the lower plug head 111, 121, as shown in FIGS. 3, 4, and 5.

The upper case 11 of the main body 1 is provided at a top surface with an axially extended middle slide way 112, which is provided near a middle point with a lowered section 116 defining a forward and downward beveled guiding surface 117, and near a rear end with a recess 113 for receiving an elastic element 114 therein. The elastic element 114 may be a spring. Two threaded holes 115 are provided at two lateral sides of the middle slide way 112 near a rear end of the main body 1.

The pull member 2 has a rear end formed into a pull ring 24, and a front end formed into a narrowed and forward projected section 22 adapted to movably located in the middle slide way 112 on the top of the main body 1. The forward projected section 22 of the pull member 2 has a downward protruded front end 23 movably received in the lowered section 116 of the middle slide way 112. A stopper 21 is downward projected from a lower side of the forward projected section 22 near the pull ring 24 to extend into the recess 113 on the main body 1 and press against a front end of the elastic element 114.

The elastic plate 3 is provided at a rear end with two spaced fixing holes 31, so that the elastic plate 3 is flatly fixed to the top of the main body 1 above the forward projected section 22 of the pull member 2 by threading two bolts 32 through the fixing holes 31 into the two threaded holes 115 on the main body 1. Two hooks 33 are transversely spaced at a front end of the elastic plate 3 to locate above the base of the upper and lower plug heads 111, 121 for hooking to two engaging holes 42 correspondingly provided on the receptacle 4, so as to hold the plug connector to the receptacle 4.

FIGS. 4 and 5 are perspective and sectioned side views, respectively, showing the plug connector of the present invention plugged in the receptacle 4. When it is desired to unplug the main body 1 of the plug connector from the receptacle 4, simply outward pull the pull ring 24 of the pull member 2 with a finger, so that the forward projected section 22 of the pull member 2 is simultaneously moved backward and the downward protruded front end 23 is pulled out of the lowered section 116 via the beveled guiding surface 117. When the downward protruded front end 23 is moved rearward onto the middle slide way 112 to press against a middle section of the elastic plate 3 above the pull member 2, the hooks 33 at the front end of the elastic plate 3 are raised to disengage from the engaging holes 42 on the receptacle 4. At this point, the stopper 21 below the pull member 2 also compresses against the elastic member 114 in the recess 113 and pushes the whole main body 1 rearward to separate the plug heads 111, 121 of the main body 1 from the receptacle 4. When the pull ring 24 is released, the pull member 2 is pushed forward to a home position on the main body 1 by a restoring force of the elastic element 114, and the downward protruded front end 23 of the pull member 2 is received in the lowered section 116 again.

What is claimed is:

1. A plug connector, comprising:

a main body having a front end that forward projects to form a plug head for extending into a plug hole correspondingly formed on a receptacle; said main body being provided on a top surface with an axially extended middle slide way, which is provided at a middle point with a lowered section, and near a rear end with a recess for receiving an elastic element therein;

an elastic plate having a rear end fixed to a rear end of said main body opposite to said plug head, and a front end provided with two hooks that are located above a base of said plug head for hooking to two engaging holes correspondingly provided on said receptacle; and a pull member having a forward projected section located below said elastic plate to movably locate in said middle slide way on the top of said main body; said forward projected section having a downward protruded front end movably received in said lowered section of said middle slide way; a stopper being downward projected from a lower side of said forward projected section near a rear end thereof to extend into said recess on said main body and press against a front end of said elastic element;

whereby when said pull member is pulled rearward, said forward projected section is simultaneously moved rearward, causing said downward protruded front end to slide out of said lowered section onto said middle slide way and thereby upward presses against a middle section of said elastic plate above said pull member, and said hooks at the front end of said elastic plate are therefore raised to disengage from said engaging holes on said receptacle, allowing said plug head of said main body of said plug connector to unplug from said receptacle.

2. The plug connector as claimed in claim 1, wherein said lowered section on said main body defines a forward and downward beveled guiding surface.

3. The plug connector as claimed in claim 1, wherein said pull member has a rear end formed into a pull ring.

4. The plug connector as claimed in claim 1, wherein said main body is provided at two lateral sides of said middle slide way near the rear end of said main body with two threaded holes, so that two bolts may be threaded through two fixing holes formed at the rear end of said elastic plate and said threaded holes at the rear end of said main body to fix said elastic plate to said main body.

5. The plug connector as claimed in claim 1, wherein said main body is formed from an upper and a lower case closed to each other.

6. The plug connector as claimed in claim 1, wherein said elastic element is a spring.

* * * * *